US007850170B2

(12) United States Patent
Matsue et al.

(10) Patent No.: US 7,850,170 B2
(45) Date of Patent: Dec. 14, 2010

(54) STACKER DEVICE

(75) Inventors: Yasuhiro Matsue, Kahoku (JP); Takumi Nakayama, Kahoku (JP); Mitsuhiro Shikan, Kahoku (JP)

(73) Assignee: PFU Limited, Ishikawa (JP)

( * ) Notice: Subject to any disclaimer, the term of this patent is extended or adjusted under 35 U.S.C. 154(b) by 245 days.

(21) Appl. No.: 11/365,680

(22) Filed: Mar. 2, 2006

(65) Prior Publication Data

US 2006/0202412 A1 Sep. 14, 2006

(30) Foreign Application Priority Data

Mar. 4, 2005 (JP) ..... P2005-060168

(51) Int. Cl.
*B65H 39/10* (2006.01)

(52) U.S. Cl. ..... 271/294; 271/213; 271/292

(58) Field of Classification Search ..... 271/294, 271/213, 292
See application file for complete search history.

(56) References Cited

U.S. PATENT DOCUMENTS

| | | | | |
|---|---|---|---|---|
| 5,725,207 | A * | 3/1998 | Deguchi | 271/9.09 |
| 6,318,718 | B1 * | 11/2001 | Ogata et al. | 271/213 |
| 6,336,630 | B1 * | 1/2002 | Holtman et al. | 271/293 |
| 6,663,102 | B2 * | 12/2003 | Takahashi et al. | 271/217 |
| 6,711,376 | B2 | 3/2004 | Suzuki et al. | |
| 2001/0050459 | A1 * | 12/2001 | Tamura et al. | 271/217 |
| 2002/0185808 | A1 * | 12/2002 | Rilitz et al. | 271/207 |
| 2004/0051238 | A1 * | 3/2004 | Yamada et al. | 271/294 |
| 2004/0207152 | A1 * | 10/2004 | Watanabe et al. | 271/294 |
| 2004/0227282 | A1 * | 11/2004 | Grewe et al. | 271/218 |

FOREIGN PATENT DOCUMENTS

| | | |
|---|---|---|
| DE | 196 40 627 | 4/1998 |
| JP | 8-81108 | 3/1996 |
| JP | 11-147649 | 6/1999 |
| JP | 11-165937 | 6/1999 |
| JP | 2002-274737 | 9/2002 |
| JP | 2003-89462 | 3/2003 |

OTHER PUBLICATIONS

Office Action issued in corresponding German Patent Application No. 10 2006 009 684.3-27, on Oct. 4, 2007.
Chinese Patent Office Action, mailed Jul. 25, 2008 and issued in corresponding Chinese Patent Application No. 200610058782X.
Japanese Office Action issued Jan. 26, 2010 in counterpart Japanese Application No. 2005-060168.

* cited by examiner

*Primary Examiner*—Stefanos Karmis
*Assistant Examiner*—Howard Sanders

(57) ABSTRACT

A first tray is adapted to stack a paper discharged from a discharge port thereon. A lifter is operable to raise or lower the first tray. A detector is operable to detect a stacked state of the paper and the first tray. In a case where the paper is discharged onto the first tray, the first tray is raised or lowered based on the stacked state detected by the detector so as to keep a distance from the discharge port to an uppermost paper of the paper stacked on the first tray within a predetermined range.

7 Claims, 17 Drawing Sheets

FIG. 16

○ : TRANSMISSION OF LIGHT
● : SHIELDING OF LIGHT

FLOW OF OPERATION IN TRAILING END ALIGNMENT MODE (IN NORMAL USE)

| STATE 1 | STATE 2 | FIRST SENSOR | SECOND SENSOR | THIRD SENSOR | FOURTH SENSOR | FIFTH SENSOR |
|---|---|---|---|---|---|---|
| DEFAULT STATE | | ○ | ○ | ○ | ○ | ○ |
| TRAY ANGLE HOLDING PORTION IS RAISED BY X1 mm | | ○ | ○ | ○ | ○ | ○ |
| STACKER UNIT IS RAISED | RAISED BY X2 mm | ○ | ○ | ● | ○ | ○ |
| PAPER IS STACKED UNTIL LIGHT OF FIRST SENSOR IS SHIELDED | PAPER STACK HEIGHT:X mm | ● | ● | ● | ○ | ○ |
| STACKER UNIT IS LOWERED UNTIL LIGHT OF SECOND SENSOR IS TRANSMITTED | LOWERED BY X3 mm | ○ | ○ | ● | ● | ○ |
| STACKER UNIT IS LOWERED UNTIL LIGHT OF THIRD SENSOR IS TRANSMITTED | LOWERED BY X4 mm | ○ | ○ | ○ | ● | ● |
| JOB COMPLETED | | | | | | |
| TRAY ANGLE HOLDING PORTION IS LOWERED BY X5 mm | | ○ | ○ | ○ | ○ | ● |
| | | ○ | ○ | ○ | ● | ● |
| | | ○ | ○ | ● | ● | ● |
| | | ○ | ● | ● | ● | ● |
| | | ● | ● | ● | ● | ● |

FIG. 17

○ : TRANSMISSION OF LIGHT
● : SHIELDING OF LIGHT

TRAILING END ALIGNMENT MODE → LEADING END ALIGNMENT MODE (NO VERTICAL RAISING/LOWERING)

| STATE 1 | STATE 2 | FIRST SENSOR | SECOND SENSOR | THIRD SENSOR | FOURTH SENSOR | FIFTH SENSOR |
|---|---|---|---|---|---|---|
| TRAILING END ALIGNMENT MODE | DEFAULT STATE | ○ | ○ | ○ | ○ | ○ |
| LEADING END ALIGNMENT MODE | | ○ | ○ | ○ | ● | ○ |

FIG. 18

○ : TRANSMISSION OF LIGHT
● : SHIELDING OF LIGHT

DEFAULT STATE → INSTALLATION OF REJECT TRAY
(VERTICALLY RAISED/LOWERED FOR CHANGING OVER DESTINATION OF DISCHARGE)

| STATE 1 | STATE 2 | FIRST SENSOR | SECOND SENSOR | THIRD SENSOR | FOURTH SENSOR | FIFTH SENSOR |
|---|---|---|---|---|---|---|
| DEFAULT STATE | | ○ | ○ | ○ | ○ | ○ |
| REJECT TRAY IS INSTALLED | | ○ | ○ | ● | ○ | ○ |
| TRAY ANGLE HOLDING PORTION IS RAISED BY X6 mm | | ○ | ○ | ● | ○ | ○ |
| NORMAL DISCHARGE | RAISED BY X7 mm | ○ | ○ | ● | ○ | ○ |
| REJECT DISCHARGE | LOWERED BY X8 mm | ○ | ○ | ● | ○ | ○ |
| JOB COMPLETED | | | | | | |
| TRAY ANGLE HOLDING PORTION IS LOWERED BY X9 mm | | ○ | ○ | ● | ○ | ● |
| | | ○ | ○ | ● | ● | ● |
| | | ○ | ● | ● | ● | ● |

FIG. 19

○ : TRANSMISSION OF LIGHT
● : SHIELDING OF LIGHT

AUTOMATIC OPENING OF EXTENSION TRAY (BY VERTICAL RAISING/LOWERING OF TRAY)

| STATE 1 | STATE 2 | FIRST SENSOR | SECOND SENSOR | THIRD SENSOR | FOURTH SENSOR | FIFTH SENSOR |
|---|---|---|---|---|---|---|
| DEFAULT STATE | EXTENSION TRAY IS CLOSED | ○ | ○ | ○ | ○ | ○ |
| POWER SUPPLY IS TURNED ON | | | | | | |
| TRAY ANGLE HOLDING PORTION IS RAISED BY X10 mm | LATCH OF EXTENSION TRAY IS DISENGAGED FROM STOPPER TO ROTATE AND OPEN EXTENSION TRAY | ○ | ○ | ○ | ○ | ○ |

STACKER DEVICE

BACKGROUND OF THE INVENTION

The present invention relates to a stacker device used in, for example, a sheet feed type image reading apparatus or the like, and more particularly to a stacker device provided with a lifting member for raising or lowering a tray.

In a sheet feed type image reading apparatus, a hopper unit for stacking and accommodating paper or the like which is subject to reading and a stacker unit in which the paper or the like for which reading has been completed is stacked are generally disposed separately. A read head for reading characters, images, and the like on the paper or the like is disposed midway in a transport passage from the hopper unit to the stacker unit.

There is a type of a stacker unit which includes a stacker in which the paper or the like for which reading has been completed properly is stacked and a reject stacker in which the paper or the like for which reading has not been completed properly is stacked. The paper or the like which has been read by the read head is sorted into the respective stackers depending on the result of reading.

For example, in a related stacker device, in order to ensure that the discharged sheets can be stacked orderly without being arranged haphazardly, the discharged sheets are consecutively transported to a tray, and when the sheets have been stacked by a fixed quantity, the tray is lowered. (Refer to, for example, JP-A-11-165937.)

In addition, in a related device which has a rejecting function for a case in which a fault has occurred in reading, recognition, and the like, a structure is adopted in which a paper transporting passage separate from a normal transport passage is generally provided for rejection to discharge the rejected sheet onto a separate tray. (Refer to, for example, JP-A-08-081108.)

As described above, the following problems are encountered in the related art.

The capacities of the hopper and the stacker have come to increase in conjunction with improvement in the processing performance. With the related art, if the stacking depth becomes deep, since the stiffness is low particularly in the case of thin paper, there is a problem in that the leading end droops down, so that the paper drops in a curled state, and the stacking characteristic becomes very poor.

In addition, optimal stacking conditions vary depending on thin paper with weak stiffness, thick paper, and large- or small-sized paper. However since no consideration is given to the stacking positions corresponding to the types of paper, there is a problem in that paper with a poor stacking characteristic is generated.

Since there are many cases where the discharged paper tray is provided on an upper side of the device in conjunction with the trend toward a large-sized device, and an extension is extended to stack a large-sized medium, there is a problem in that the paper is very difficult to remove.

In the device which has the rejecting function for a case in which a fault has occurred in reading, recognition, and the like, the structure is adopted in which a paper transporting passage separate from a normal transport passage is generally provided for rejection to discharge the rejected sheet onto a separate tray. However, since the separate transporting passage is provided, there is a problem in that the device becomes large in size.

SUMMARY

It is therefore an object of the invention to provide a stacker device which is capable of controlling the stacking conditions optimally in correspondence with, for example, thin paper with weak stiffness, thick paper, and large- or small-sized paper, and of improving the operational efficiency in removing the paper.

It is also an object of the invention to provide a stacker device which is capable of improving the stacking characteristic of a large-sized medium and of rendering the device compact.

It is also an object of the invention to provide a stacker device which provides control such that it is unnecessary to provide a paper transporting passage separate from a normal discharging passage in the discharging of rejected paper.

Namely, it is an object of the invention to provide a stacker device which is capable of providing control to overcome the above-described problems by a lifting member which raises and lowers the tray on which the paper is stacked.

In order to achieve the object, according to the invention, there is provided a stacker device comprising:

a first tray, adapted to stack a paper discharged from a discharge port thereon;

a lifter, operable to raise or lower the first tray; and a detector, operable to detect a stacked state of the paper and the first tray, wherein in a case where the paper is discharged onto the first tray, the first tray is raised or lowered based on the stacked state detected by the detector so as to keep a distance from the discharge port to an uppermost paper of the paper stacked on the first tray within a predetermined range.

The paper may be discharged onto the first tray, thereby a paper discharging is performed, after the paper discharging is finished, the first tray may be lowered to a predetermined position and an angle of the first tray may be set to be in substantially horizontal.

With this configuration, by virtue of the lifter which raises and lowers the first tray on which the paper is stacked, it becomes possible to optimize the stacking conditions in correspondence with, for example, thin paper with weak stiffness, thick paper, and large- or small-sized paper, and improve the operational efficiency in removing the paper.

The stacker device may further have a second tray, arranged at an upper side of the first tray, and adapted to stack the paper discharged from the discharge port thereon. In a case where the paper is discharged onto the second tray, the first tray may be lowered.

In this case, it becomes possible to commonly use the paper transporting passage for both the discharged of the rejected paper and the discharge of the normal paper, thereby rendering the device compact.

The stacker device may further have an extension tray, rotatably disposed at one end portion of the first tray, and serving as a door cover of the device.

The other end portion of the extension tray may be fixed to a stopper portion of the device, so that the device may be in a closed state.

The first tray may be raised, thereby the other end portion of the extension tray may be separated from the stopper portion of the device, so that the device may be in a usable state.

In this case, it becomes possible to improve the stacking characteristic of a large-sized medium and render the device compact.

The distance may be associated with types of the paper.

In order to achieve the object, according to the invention, there is also provided a stacker device comprising:

a tray, adapted to stack a paper discharged from a discharge port thereon;

a lifter, operable to raise or lower the first tray;

a detector, operable to detect a stacked state of the paper and the tray; and a controller: operable to cause the paper to be discharged onto the tray; and operable to cause the lifter to raise or lower the tray based on the stacked state detected by the detector so as to keep within a predetermined range a paper stack depth which is a distance from the discharge port to an uppermost paper of the paper stacked on the tray.

The stacker device may further have an adjuster, operable to adjust an angle of the tray. The paper may be discharged onto the tray, thereby a paper discharging is performed, and after the paper discharging is finished, the controller may cause the lifter to lower the tray to a predetermined position, and cause the adjuster to adjust the angle of the tray to be substantially horizontal.

The tray may include a first tray and a second tray arranged at an upper side of the first tray, in a case where the controller causes the paper to be discharged onto the first tray, the paper stack depth may be a distance from the discharge port to an uppermost paper of the paper stacked on the first tray, in a case where the controller causes: the lifter to lower the first tray; and the paper to be discharged onto the second tray, the paper stack depth may be a distance from the discharge port to an uppermost paper of the paper stacked on the second tray.

In order to achieve the object, according to the invention, there is also provided a method of stacking a paper in stacker device having a tray, adapted to stack the paper discharged from a discharge port thereon, the method comprising:

discharging the paper onto the tray, thereby a paper discharging is performed;

detecting a stacked state of the paper and the tray; and vertically moving the tray based on the detected stacked state so as to keep within a predetermined range a distance from the discharge port to an uppermost paper of the paper stacked on the tray.

The method may further have lowering the tray to a predetermined position after the paper discharging is finished, and setting an angle of the tray to be substantially horizontal at the predetermined position.

BRIEF DESCRIPTION OF THE DRAWINGS

FIG. 16 is a table explaining the operation in the paper trailing end alignment mode of the stacker device in accordance with the invention;

FIG. 17 is a table explaining the paper trailing end alignment mode and the paper leading end alignment mode of the stacker device in accordance with the invention;

FIG. 18 is a table explaining cases where normal paper is stacked and rejected paper is stacked in the stacker device in accordance with the invention; and FIG. 19 is a table explaining a case where the extension tray of the stacker device is used in accordance with the invention.

DETAIL DESCRIPTION OF PREFERRED EMBODIMENTS

Referring to FIGS. 1 to 19, a description will be given of the best mode for carrying out the invention.

Figure 2:
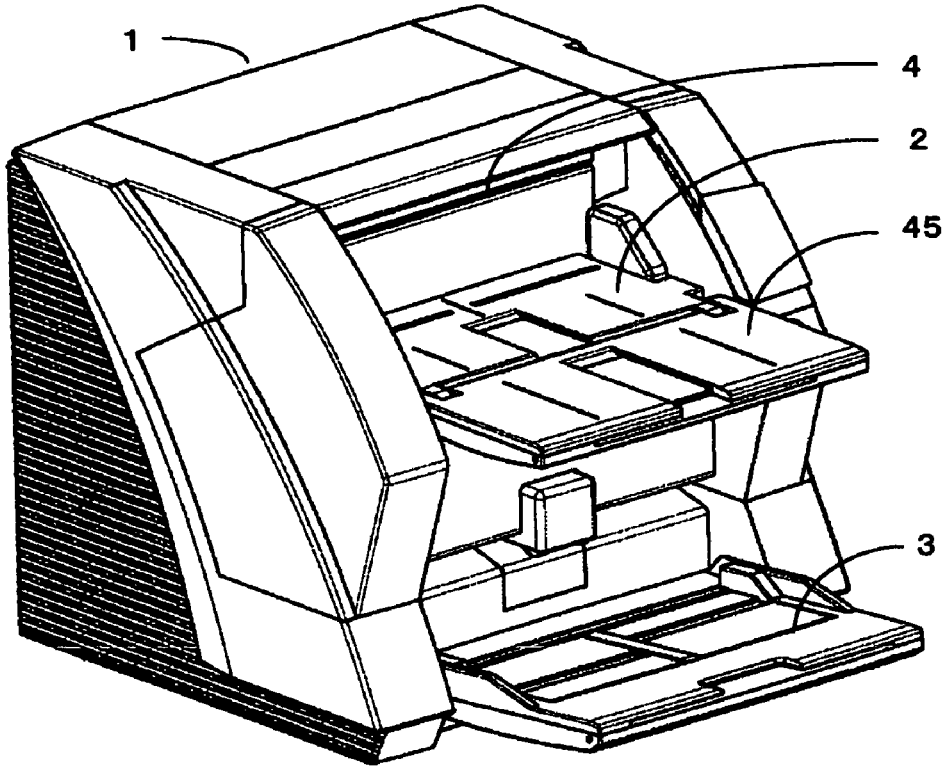
FIG. 2 is an external view of an image reading apparatus to which the stacker device in accordance with the invention is applied.

FIG. 2 is an external view of an image reading apparatus to which a stacker device in accordance with the invention is applied. In the drawing, in an image reading apparatus 1, a hopper device 3 for stacking document paper which is subject to reading and a stacker device 2 in which the document paper for which reading has been completed is stacked are disposed separately. A read head for reading characters, images, and the like on the document paper is disposed midway in a transport passage from the hopper device 3 to the stacker device 2. It should be noted that an extension tray 45 for stacking a large-sized medium is provided in the stacker device 2.

Figure 1:
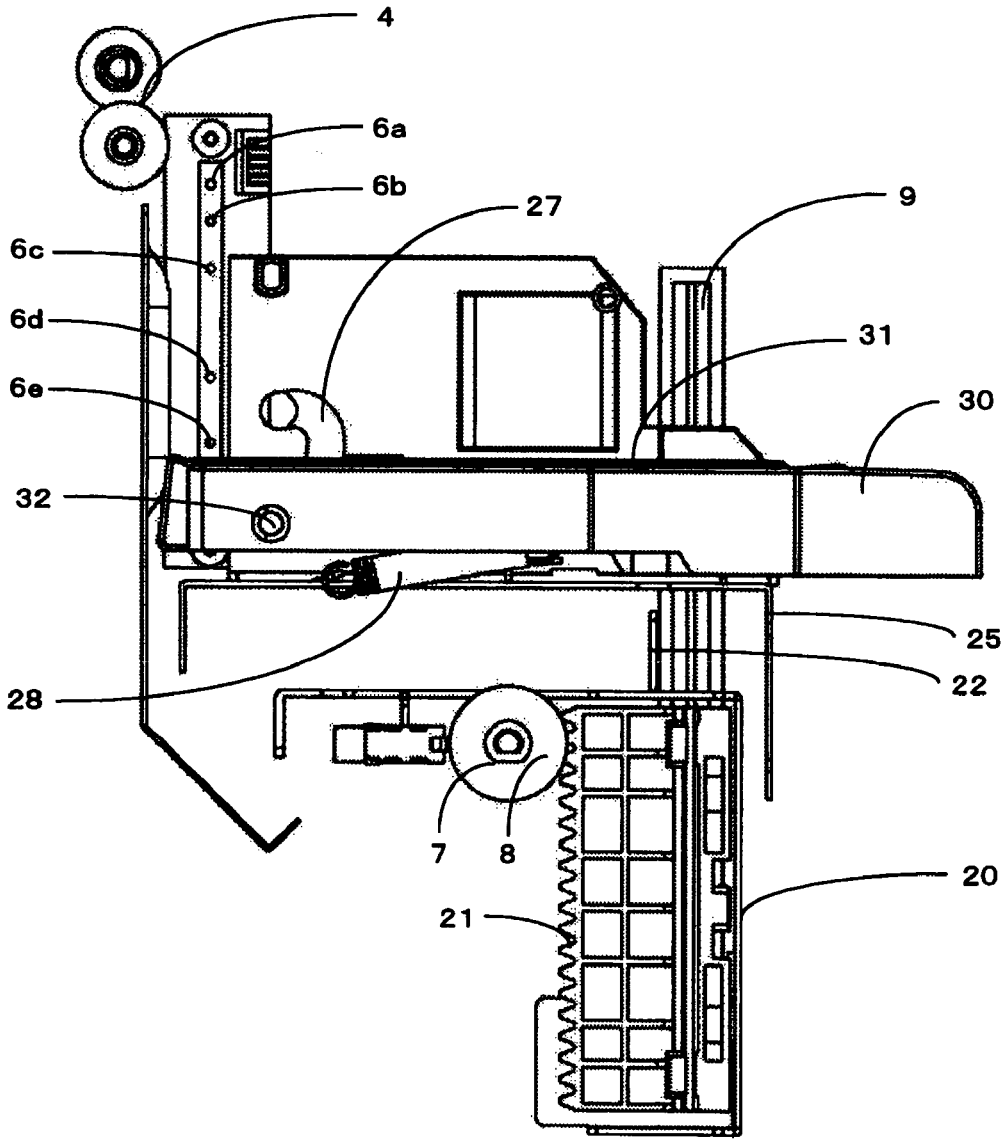
FIG. 1 is a diagram explaining the basic principle of the stacker device in accordance with the invention.
Figure 3:
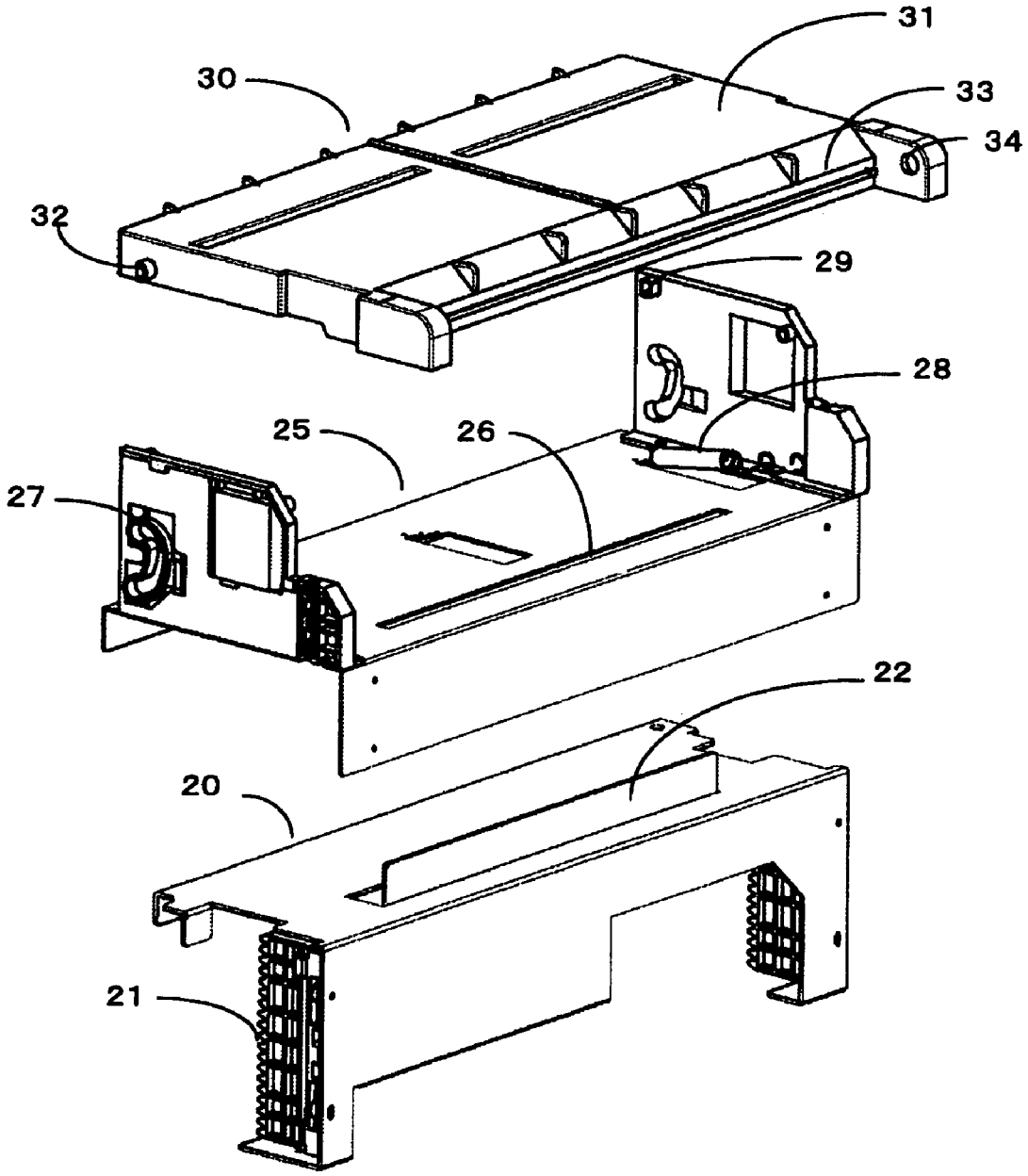
FIG. 3 is an explanatory diagram of a main portion of the stacker device in accordance with the invention.

FIG. 1 is a diagram explaining the basic principle of the stacker device in accordance with the invention. FIG. 3 is an explanatory diagram of a main portion of the stacker device in accordance with the invention. In FIGS. 1 and 3, the stacker device has as its main components a lifting member 20, an intermediate member 25, and a tray 30 for forming a paper stacking surface 31.

A position of the tray 30 is controlled by a controller not shown in drawings.

The lifting member 20 has a pair of racks 21 formed thereon, the drive of a motor 7 provided on the image reading apparatus 1 is transmitted to the racks 21 by a pair of pinions 8, and the lifting member 20 undergoes a raising/lowering operation along a pair of stacker lift rails 9 provided in the image reading apparatus 1. It should be noted that a tray angle holding portion 22 is formed on the lifting member 20, is inserted in a hole portion 26 formed in the intermediate member 25, and is made capable of contacting the tray 30. An angle of the tray 30 is adjusted and changed by the tray angle holding portion 22.

In the intermediate member 25, a tray angle changeover slot 27 is formed in its side wall, a projecting portion 32 formed on the tray 30 is fitted in the tray angle changeover slot 27, so that the projecting portion 32 is movable along the shape of the tray angle changeover slot 27. The angle of the tray 30 is adjusted and changed by the projecting portion 32 and the tray angle changeover slot 27. It should be noted that a pair of mounting portions 29 are formed on the intermediate member 25 to mount a reject tray 40 which will be described later.

A tray angle holding spring 28 is formed by a tension spring, and its one end is fixed to the intermediate member 25, while its other end is fixed to the tray 30 to urge the tray 30 in the downward direction. A pair of mounting portions 34 are respectively formed on both walls of a distal end portion 33 of the tray to rotatably mount the aforementioned extension tray 45.

In FIG. 1, the document paper for which reading has been completed is discharged from a paper discharge portion 4, and is stacked on the paper stacking surface 31 of the tray 30 disposed below the paper discharge port 4. In addition, a light transmitting-type sensor group 6, which projects light, for example, from one side in the widthwise direction of the tray 30 and receives the light at the other side thereof, is disposed in the vicinity of the paper discharge port 4 in side wall portions below it. The states of the tray 30 and the paper stacked on the tray 30 are detected according to whether or not the sensor group 6 continued the transmission of the light or the shielding of the light at a predetermined time interval. The sensor group 6 includes a plurality of sensors 6*a* to 6*e* arranged vertically. For example, a first sensor 6*a* and a second sensor 6*b* detect whether or not the paper stacked on the tray 30 has reached up to those sensors. A third sensor 6*c*, a fourth sensor 6*d*, and a fifth sensor 6*e* detect whether or not the tray 30 has reached up to those sensors.

Referring to FIGS. 4, 5, 6, 7, and 16, a description will be given of one example of the normal use of the stacker device in accordance with the invention. It should be noted that the mode is set in a paper trailing end alignment mode in this description.

Figure 4:
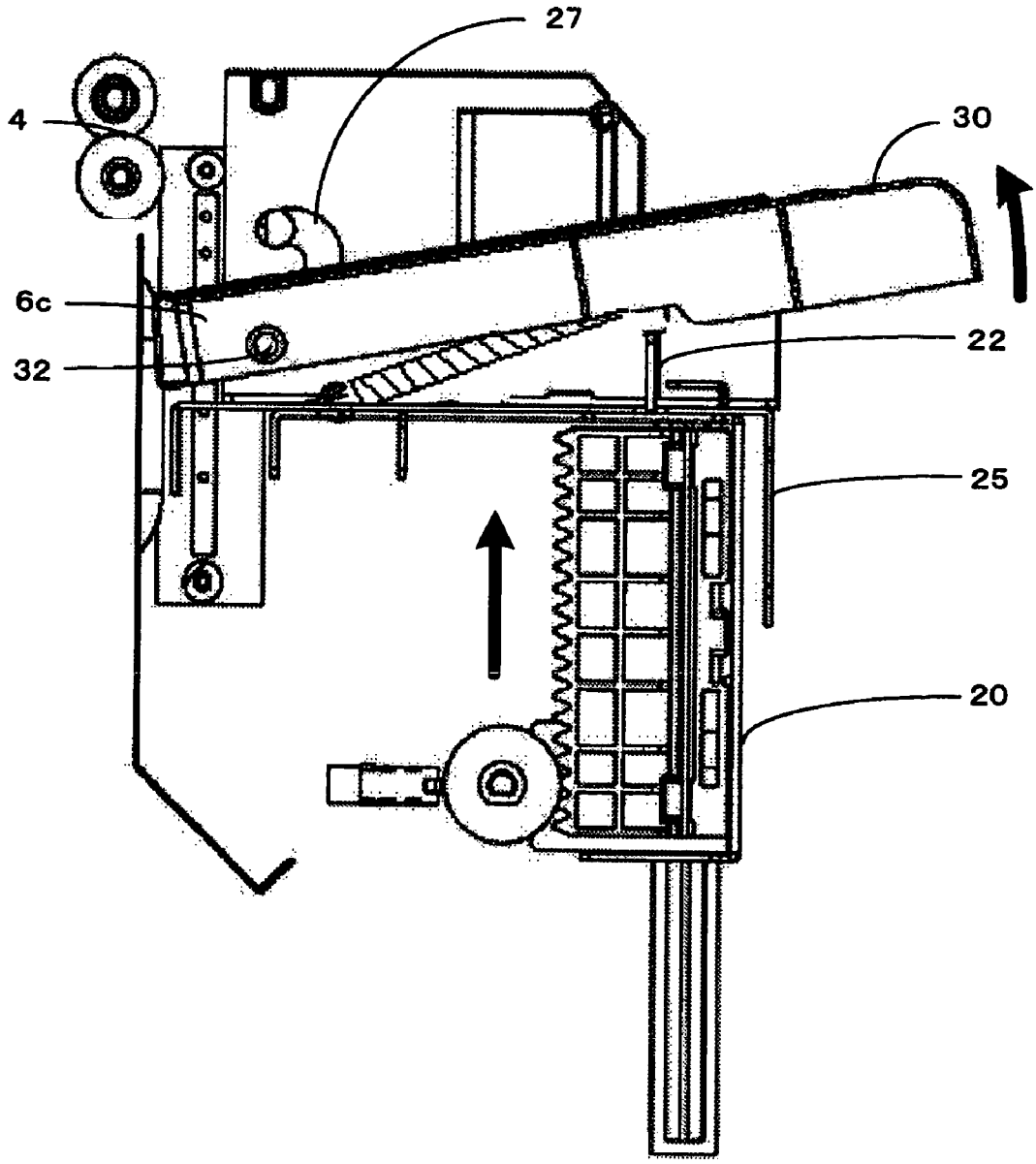
FIG. 4 is an explanatory diagram of an initial position of the stack in the stacker device in accordance with the invention.

FIG. 4 is an explanatory diagram of an initial position of the stack in the stacker device in accordance with the invention. In the drawing, in a default state (it is assumed that the tray 30 is at a lowermost position at which the sensor group 6 does not detect the tray 30), the lifting member 20 is raised to tilt the tray 30 by raising the tray angle holding portion 22 by X1 mm, thereby setting the paper trailing end alignment mode. Next, the lifting member 20 is raised by X2 mm until the third sensor 6*c* detects the tray 30. This state is set as the initial position of the stack of the stacker device.

Figure 5:
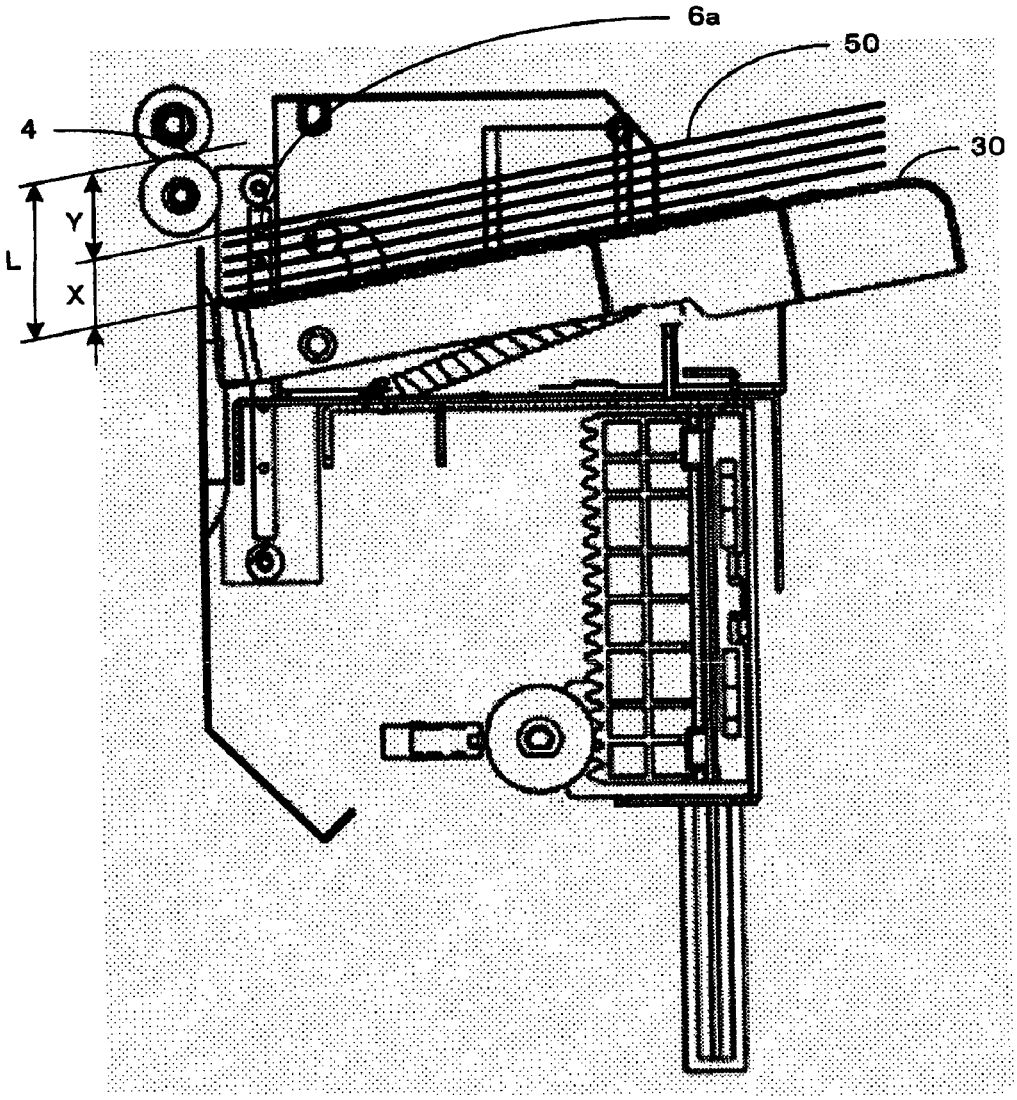
FIG. 5 is an explanatory diagram of a paper stacked state of the stacker device in accordance with the invention.

FIG. 5 is an explanatory diagram of a paper stacked state of the stacker device in accordance with the invention. In the drawing, the paper is stacked until the first sensor 6*a* detects normal paper 50. The paper stack height at this time is assumed to be X mm.

Figure 6:
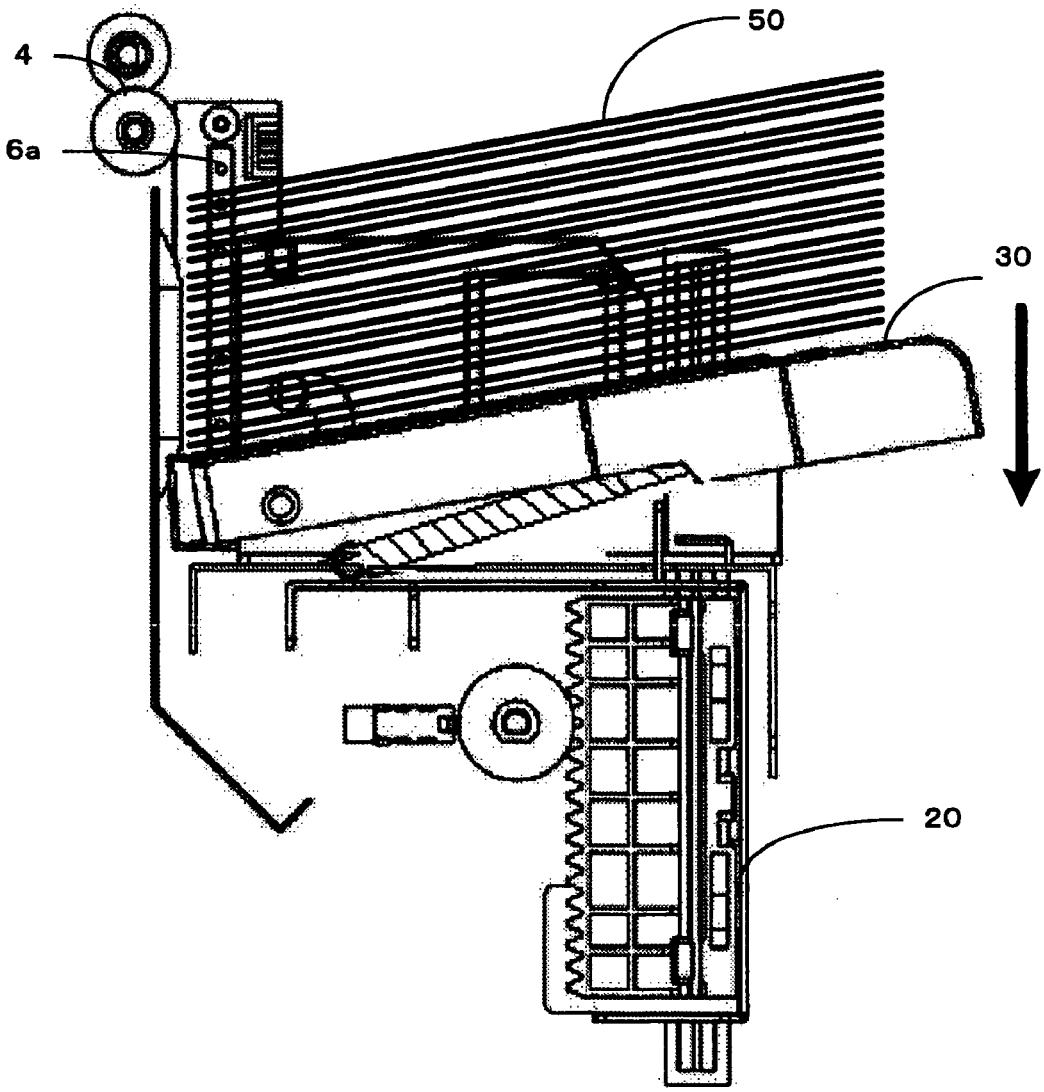
FIG. 6 is an explanatory diagram of the paper stacked state of the stacker device in accordance with the invention.

FIG. 6 is an explanatory diagram of the paper stacked state of the stacker device in accordance with the invention. In the drawing, the lifting member 20 is lowered by X3 mm until the second sensor 6*b* transmits the light. The lifting member 20 is further lowered by X4 mm until the third sensor 6*c* transmits the light. Then, the normal paper 50 is continued to be stacked. Thus, in order to keep within a predetermined range the paper stack depth Y (see FIG. 5), which is the distance from the paper discharge port 4 to the uppermost paper of the paper stacked on the tray 30, the tray 30 is moved downward so that the paper stack height L (see FIG. 5), which is the distance from the paper stacking surface 31 of the tray 30 to the paper discharge port 4, becomes gradually large.

It should be noted that the initial position of the stack of the stacker device is set appropriately depending on thin paper with weak stiffness and thick paper, respectively. For example, the initial position of the stack of the stacker device for stacking thin paper with weak stiffness is set to a position up to which the lifting member 20 is raised until the second sensor 6*b* detects the tray 30. Thus, the paper stack depth Y, which is the distance from the paper discharge port 4 to the uppermost sheet of the paper stacked on the tray 30, is controlled so as to be maintained in a predetermined range so that optimal stacking conditions will be obtained in correspondence with the paper such as weak paper with weak stiffness and thick paper.

Figure 7:
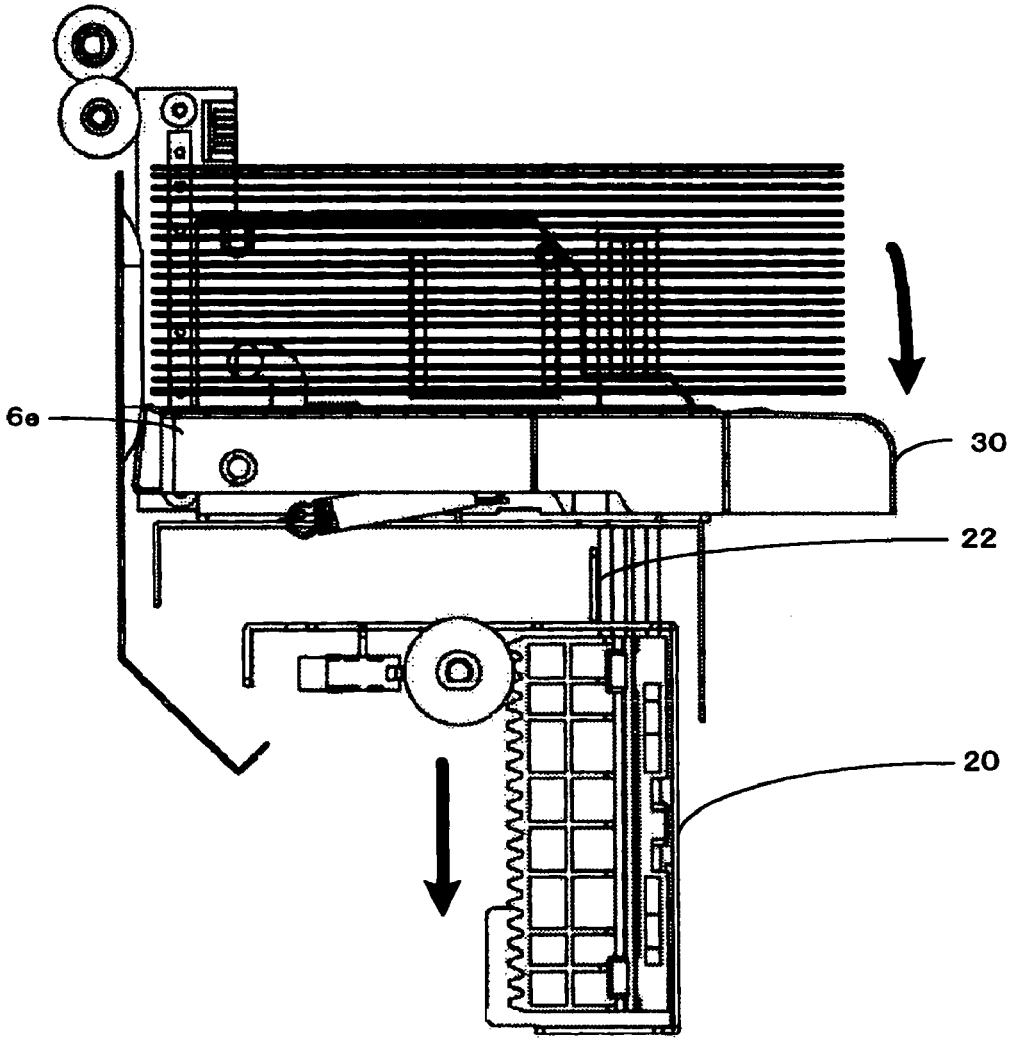
FIG. 7 is an explanatory diagram of the stacker device when the paper is removed in accordance with the invention.

FIG. 7 is an explanatory diagram of the stacker device when the paper is removed in accordance with the invention. In the drawing, when a job is completed (a paper discharging is finished) and the paper is to be removed, the lifting member 20 is lowered until the fifth sensor 6*e* detects the tray 30. The lifting member 20 is further lowered to lower the tray angle holding portion 22 by X5 mm. As a result, control is provided such that the tray 30 is set to the lower position, and the paper stacking surface 31 becomes substantially horizontal. In this state, the paper stacked in the stacker device is removed.

In FIG. 16, it is determined that the sensor is off when the light is continued to be shielded for T msec which is a predetermined value. That is similar in FIGS. 17 to 19

Figure 8:
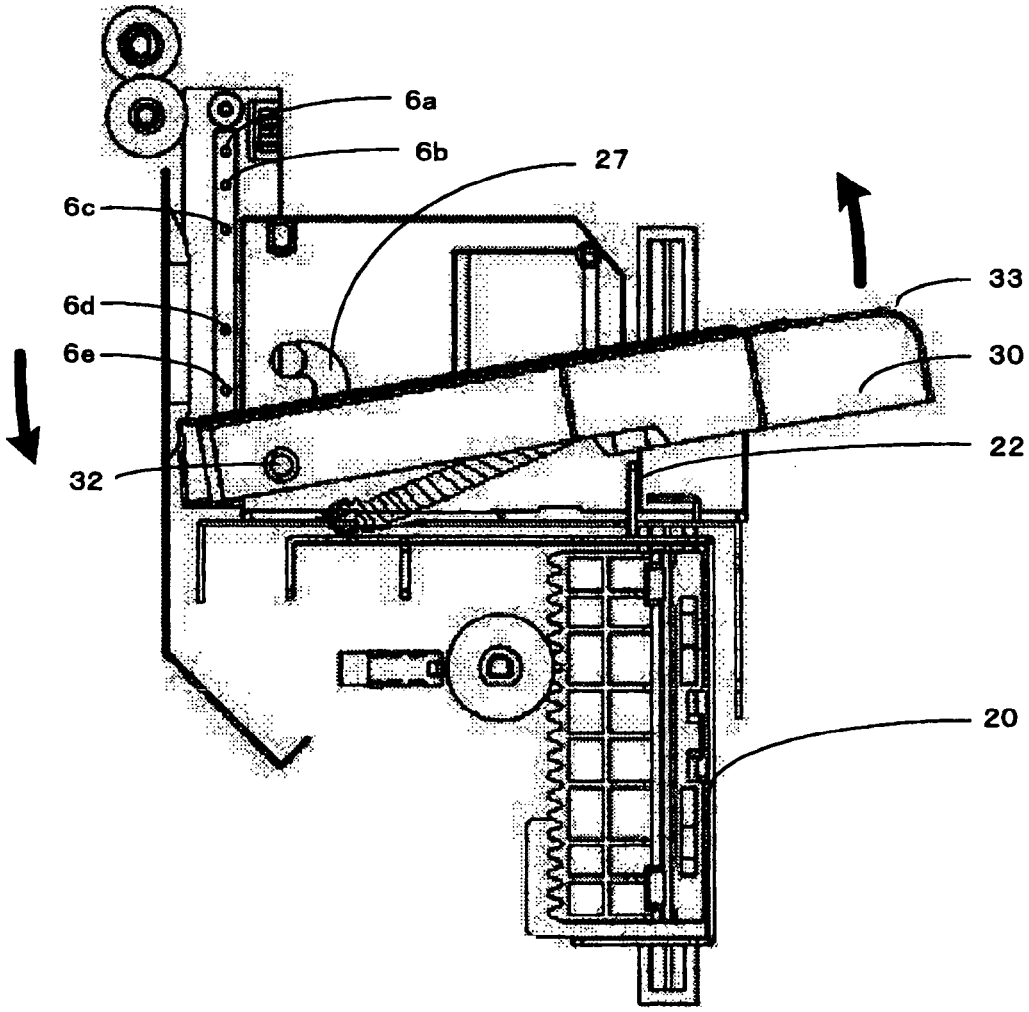
FIG. 8 is an explanatory diagram of a paper trailing end alignment mode of the stacker device in accordance with the invention.
Figure 9:
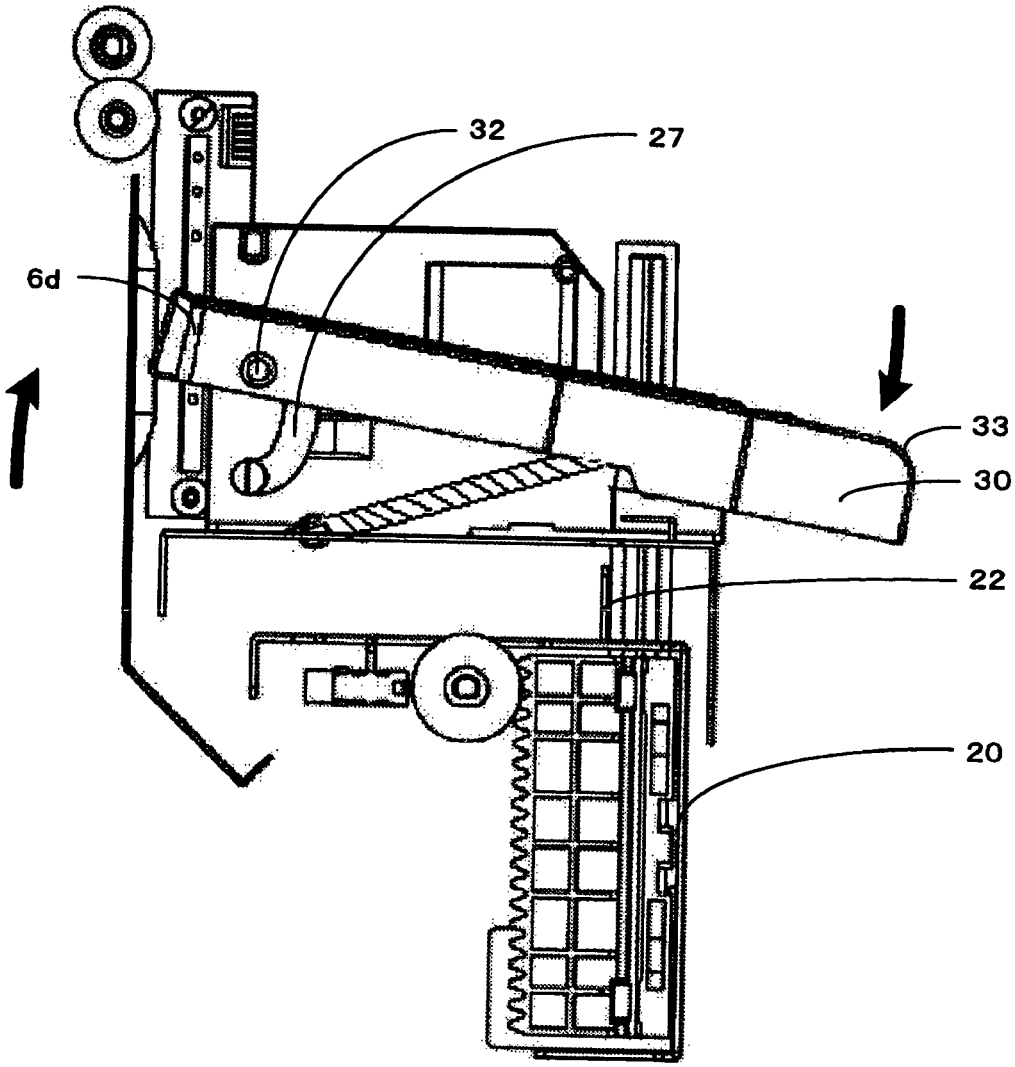
FIG. 9 is an explanatory diagram of a paper leading end alignment mode of the stacker device in accordance with the invention.

Referring to FIGS. 8, 9, and 17, a description will be given of a case where the paper trailing end alignment mode of the stacker device in accordance with the invention is shifted to a paper leading end alignment mode.

FIG. 8 is an explanatory diagram of the paper trailing end alignment mode of the stacker device in accordance with the invention. In the drawing, the tray 30 is set at the lowest position at which the sensor group 6 does not detect the tray 30. As for the tray 30, the lifting member 20 is raised to allow the tray angle holding portion 22 to be brought into contact with the tray 30 and to be raised by a predetermined distance, so that the projecting portion 32 is moved to a lowermost position in the tray angle changeover slot 27, thereby tilting the distal end portion 33 upward.

FIG. 9 is an explanatory diagram of the paper leading end alignment mode of the stacker device in accordance with the invention. In the drawing, the aforementioned state of FIG. 8 is set as a default state, and in the paper leading end alignment mode, the lifting member 20 is lowered to lower the tray angle holding portion 22 by a predetermined distance and move the projecting portion 32 to an uppermost position in the tray angle changeover slot 27, thereby tilting the distal end portion 33 downward. It should be noted that, in this state, the fourth sensor 6*d* detects the tray 30.

Figure 10:
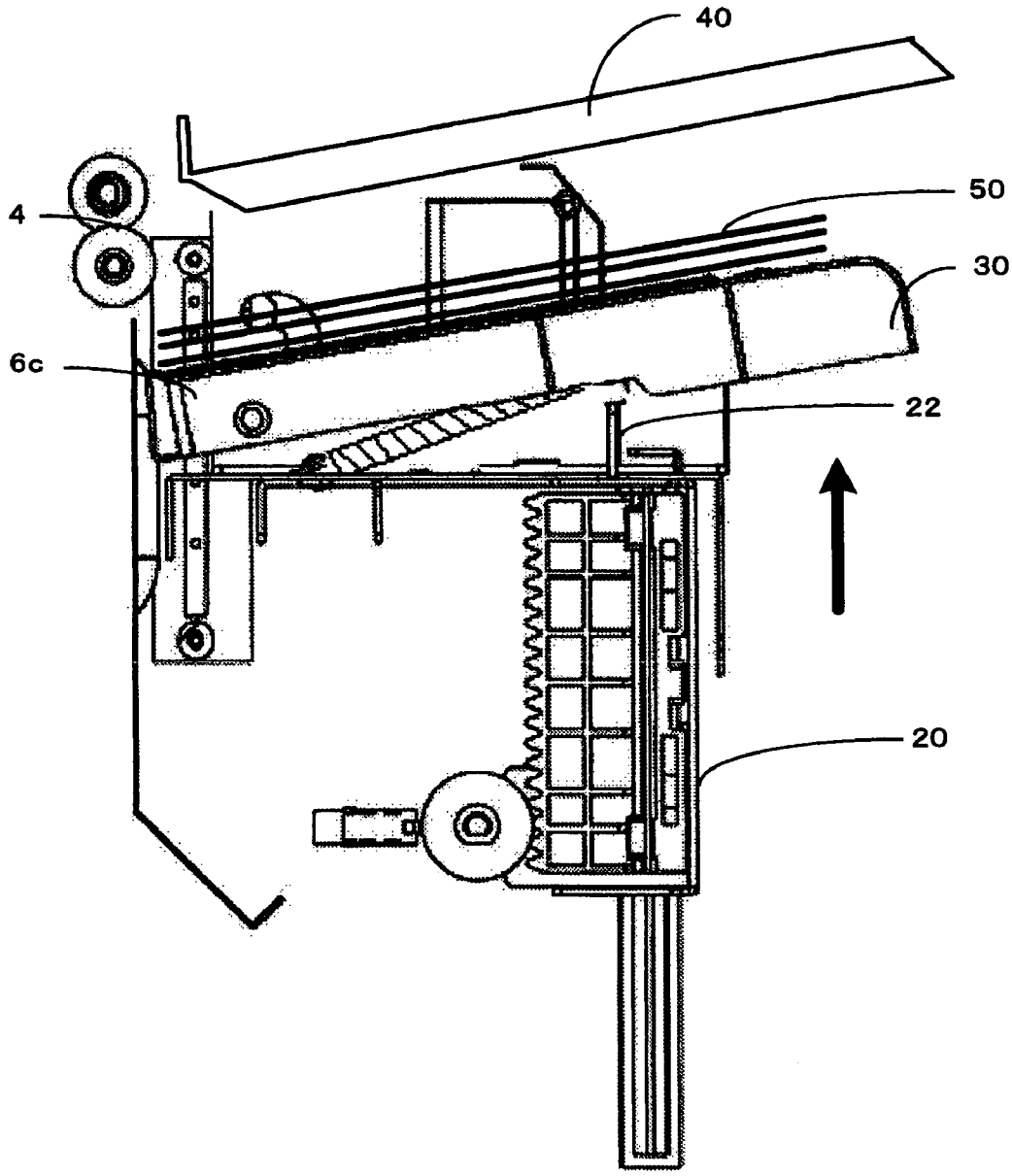
FIG. 10 is an explanatory diagram of the stacker device when normal paper is stacked in accordance with the invention.
Figure 11:
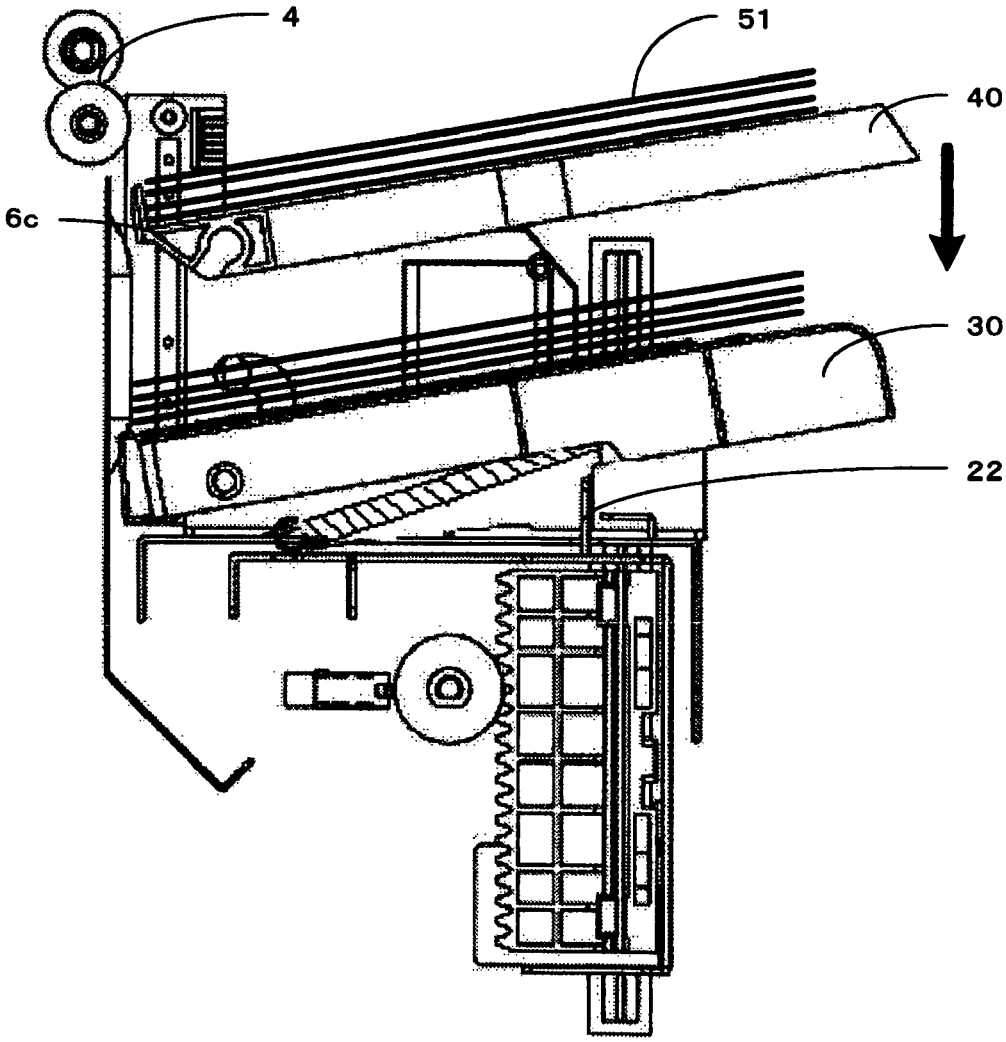
FIG. 11 is an explanatory diagram of the stacker device when rejected paper is stacked in accordance with the invention.

Referring to FIGS. 10, 11, and 18, a description will be given of a case where normal paper and rejected paper are stacked in the stacker device in accordance with the invention. It should be noted that the mode is set in the paper trailing end alignment mode in this description.

FIG. 10 is an explanatory diagram of the stacker device when normal paper is stacked in accordance with the invention. FIG. 11 is an explanatory diagram of the stacker device when rejected paper is stacked in accordance with the invention. It is assumed that in the default state the tray 30 is at the lowermost position at which the sensor group 6 does not detect the tray 30.

The reject tray 40 is fitted at the mounting portions 29 (see FIG. 3) provided on the intermediate member 25 and is thereby installed at a predetermined position in a stage higher than the tray 30. It should be noted that, in this state, the third sensor 6*c* detects the reject tray 40. Next, the lifting member 20 is raised to raise the tray angle holding portion 22 by X6 mm and tilt the try 30, thereby setting the paper trailing end alignment mode. In the normal discharge, the lifting member 20 is raised by X7 mm until the third sensor 6*c* detects the tray 30, as shown in FIG. 10. Then, the normal paper 50 discharged from the paper discharge port 4 is stacked on the tray 30.

In the discharge of rejected paper in the case where a fault has occurred in reading, recognition, or the like, the lifting member 20 is lowered by X8 mm until the third sensor 6*c* detects the reject tray 40. Then, rejected paper 51 discharged from the paper discharge port 4 is stacked on the reject tray 40. Upon completion of the job, the lifting member 20 is lowered until the fifth sensor 6*e* detects the tray 30. The lifting member 20 is further lowered to lower the tray angle holding portion 22 by X9 mm. As a result, the tray 30 is set the lower position, and the paper stacking surfaces of the tray 30 and the reject tray 40 are made substantially horizontal. In this state, the normal paper 50 stacked on the tray 30 and the rejected paper 51 stacked on the reject tray 40 are removed.

Referring to FIGS. 12, 13, 14, 15, and 19, a description will be given of other use of the stacker device in accordance with the invention.

Figure 12:
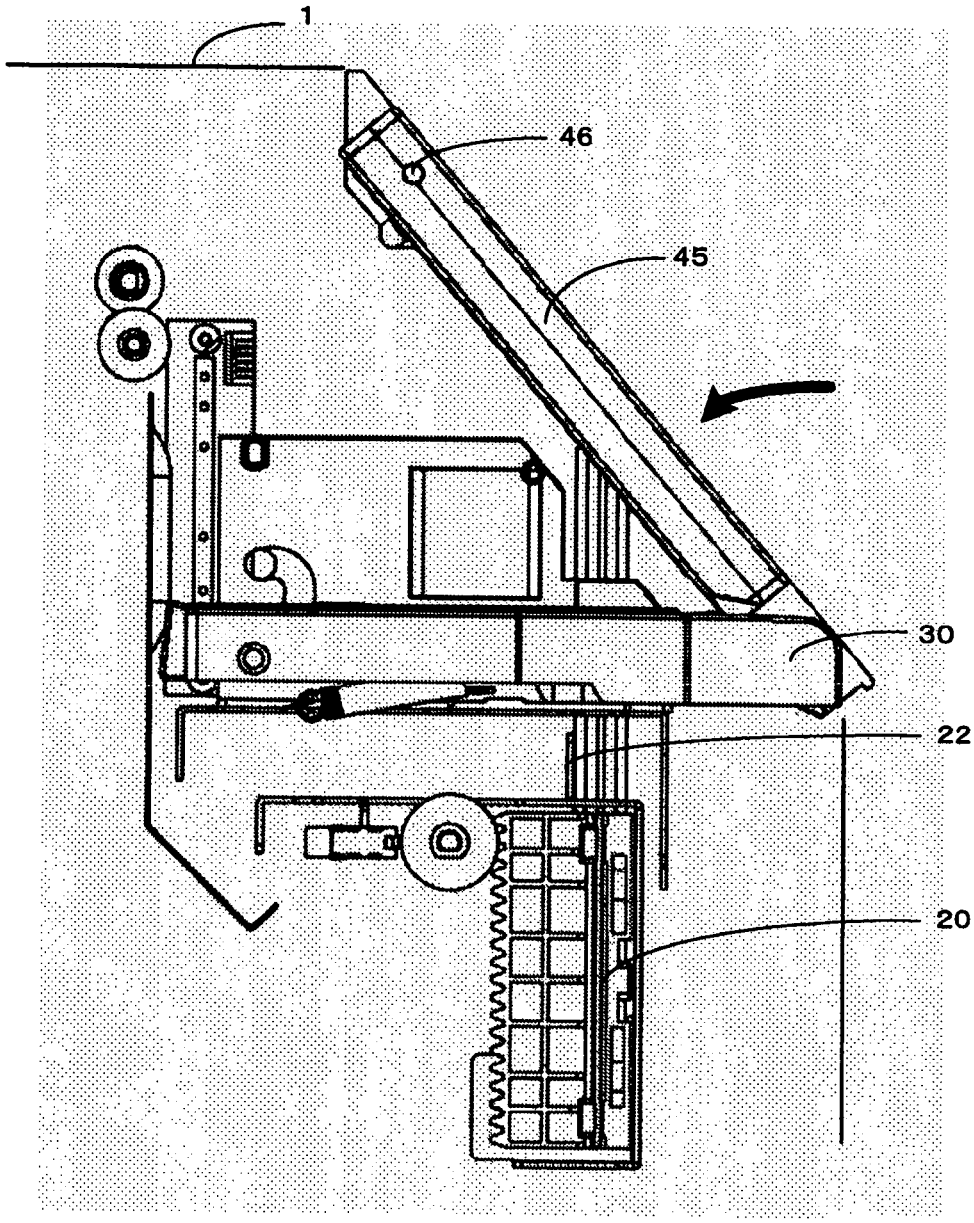
FIG. 12 an explanatory diagram of the stacker device when it is not used in accordance with the invention.
Figure 13:
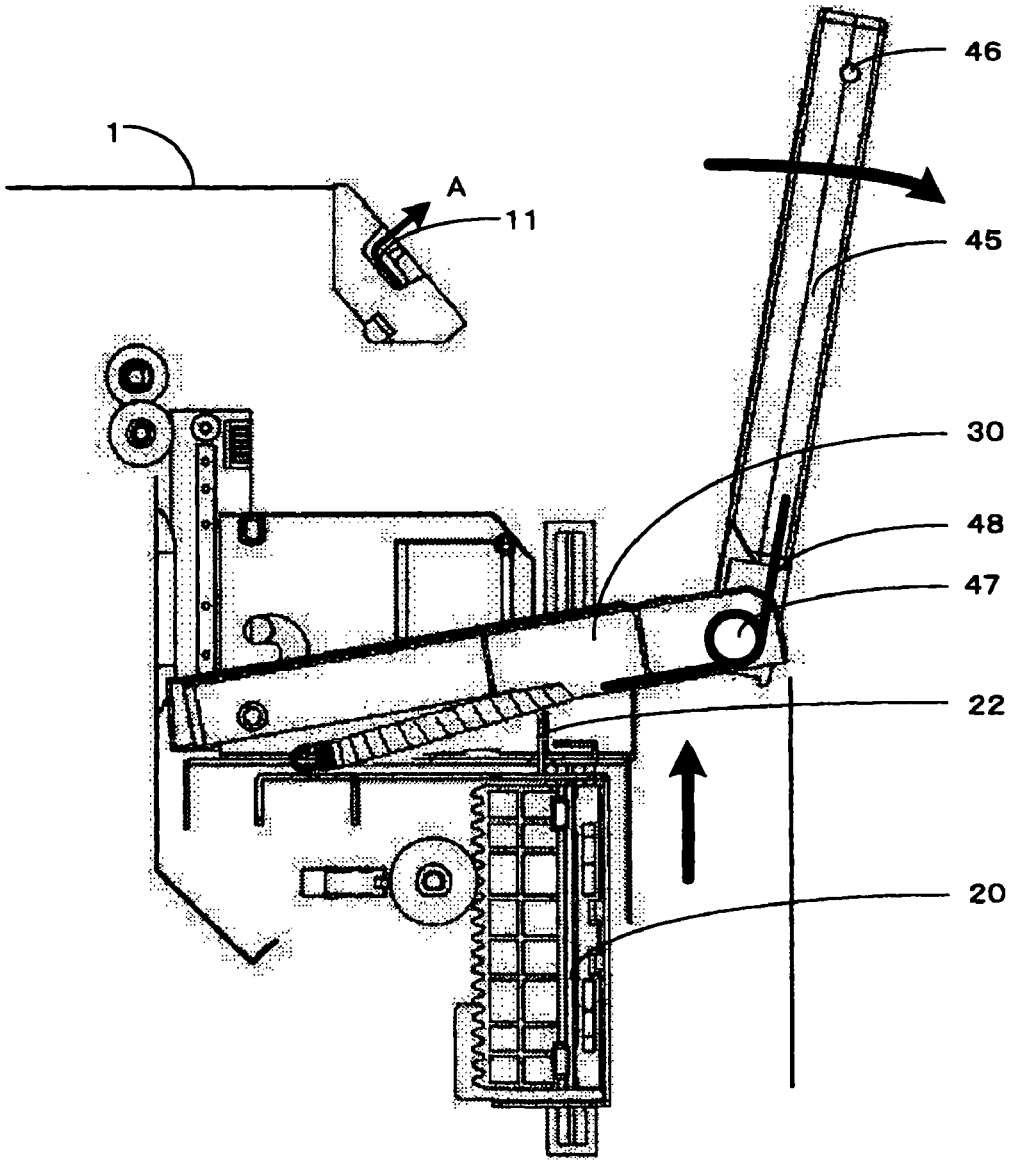
FIG. 13 an explanatory diagram of the stacker device when it is used in accordance with the invention.

FIG. 12 an explanatory diagram of the stacker device when it is not used in accordance with the invention. FIG. 13 an explanatory diagram of the stacker device when it is used in accordance with the invention. In FIGS. 12 and 13, the extension tray 45 is provided for a case where a large-sized medium is stacked. The extension tray 45 has one end fitted rotatably on the mounting portions 34 (see FIG. 3) provided on the tray 30. When the stacker device is not used, a latch 46 provided on a side wall at the other end of the extension tray 45 is inserted in a stopper 11 provided on the image reading apparatus 1, and the extension tray 45 is accommodated in the image reading apparatus 1 so that the extension tray 45 serves an external cover of the main body of the image reading apparatus 1 (in a closed state).

When the stacker device is used, if a power supply is turned on, the lifting member 20 is raised to raise the tray angle holding portion 22 by X10 mm. As a result, as distal end portion 33 of the tray 30 is raised, a fulcrum portion 47 of the extension tray 45, which is one end of the extension tray 45, is raised, so that the latch 46 provided on the extension tray 45 is moved in the direction of arrow A from the state of being inserted in the stopper 11, and is thereby disengaged from the stopper 11 provided on the image reading apparatus 1. The extension tray 45 is further rotated by an extension tray opening spring 48 provided on the fulcrum portion 47 of the extension tray 45, and is opened.

Figure 14:
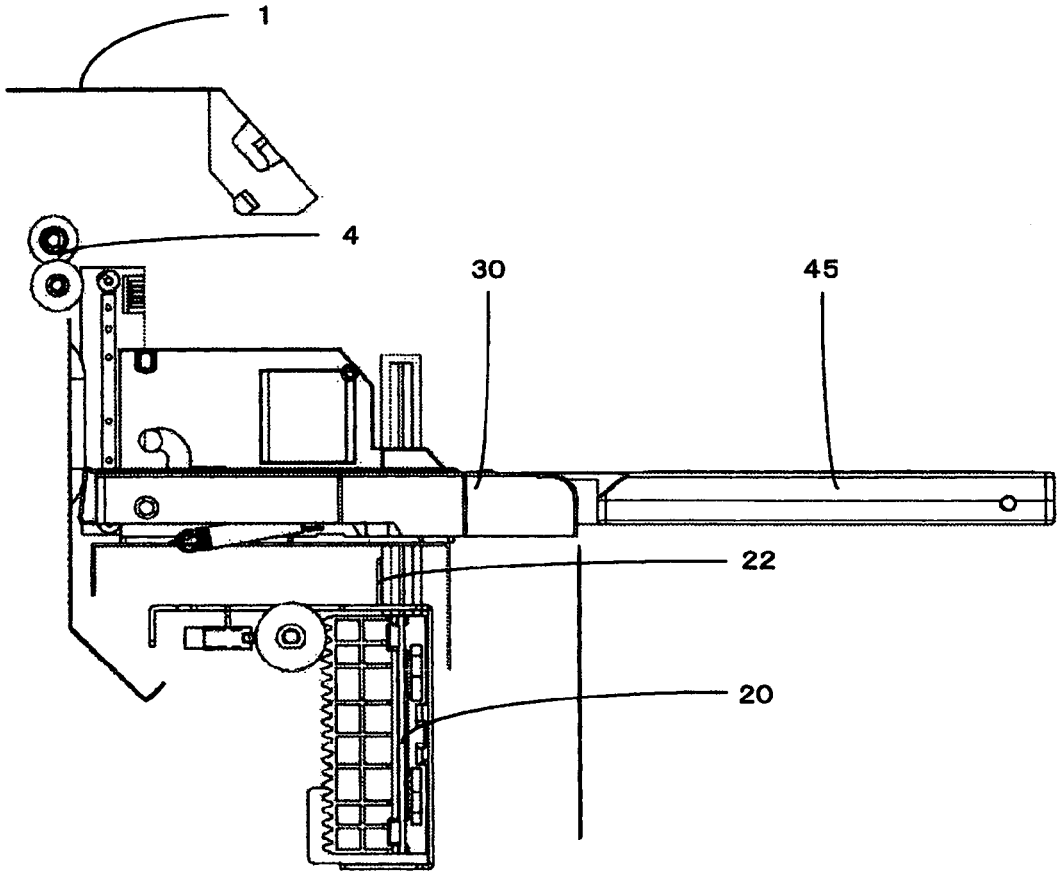
FIG. 14 is an explanatory diagram of the stacker device in which an extension tray is used in accordance with the invention.
Figure 15:
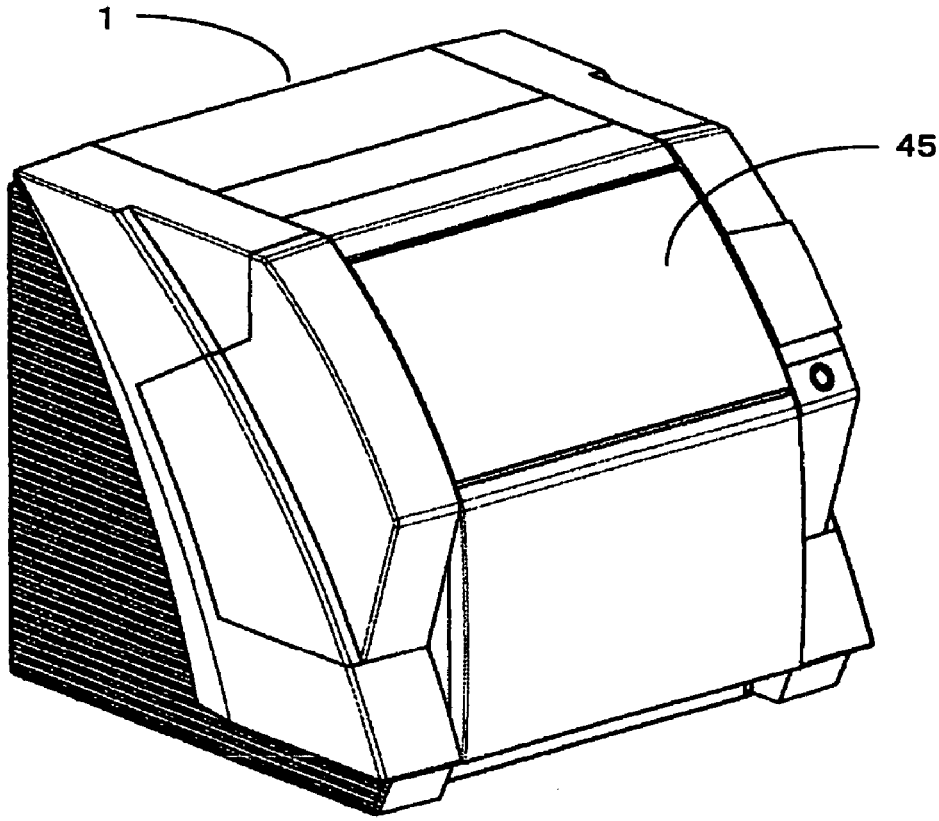
FIG. 15 is an external view of the image reading apparatus to which the stacker device in accordance with the invention is applied when the image reading apparatus is not used.

It should be noted that FIG. 14 shows a state in which the extension tray 45 of the stacker device in accordance with the invention is used. This drawing shows the default state, and the tray 30 is set at the lowest position at which the sensor group 6 does not detect the tray 30.

What is claimed is:

1. A stacker device, comprising:

a first tray, adapted to stack a paper discharged from a discharge port thereon;

a lifter, operable to raise or lower the first tray;

an extension tray, rotatably disposed at one end portion of the first tray, and serving as a door cover of the stacker device;

a stopper portion of the stacker device, wherein the stacker device is in a closed state when an end portion of the extension tray is fixed to the stopper portion; and a detector, operable to detect a stacked state of the paper and the first tray, wherein when a distance from the discharge port to an uppermost paper of the paper stacked on the first tray is modified due to the paper being discharged onto the first tray, the first tray is raised or lowered based on the stacked state detected by the detector to keep the distance within a predetermined range, wherein the first tray is tilted at a predetermined angle with a horizontal orientation while the first tray is positioned such that paper is to be discharged from the discharge port, and the lifter lowers the first tray to a predetermined position and the first tray has a substantially horizontal orientation when discharging the paper onto the first tray has ended.

2. The stacker device according to claim 1, further comprising a second tray, arranged at an upper side of the first tray, and adapted to stack the paper discharged from the discharge port thereon, wherein when the paper is discharged onto the second tray, the first tray is lowered.

3. The stacker device according to claim 1, wherein the stacker device is in a usable state when the first tray is raised and the end portion of the extension tray is separated from the stopper portion of the device.

4. The stacker device according to claim 1, wherein the distance from the discharge port to an uppermost paper of the paper stacked on the first tray depends on types of the paper.

5. A stacker device comprising:

a tray, adapted to stack a paper discharged from a discharge port thereon;

a lifter, operable to raise or lower the tray;

a detector, operable to detect a stacked state of the paper and the tray;

an extension tray, rotatably disposed at one end portion of the tray, and serving as a door cover of the stacker device;

a stopper portion of the stacker device, wherein the stacker device is in a closed state when an end portion of the extension tray is fixed to the stopper portion;

a controller operable to cause the paper to be discharged onto the tray, and operable to cause the lifter to raise or lower the tray based on the stacked state detected by the detector so as to keep a paper stack depth within a predetermined range, the paper stack depth being a distance from the discharge port to an uppermost paper of the paper stacked on the tray;

an adjuster, operable to adjust an angle of the tray, wherein while the tray is positioned such that paper is to be discharged from the discharged port, the first tray is tilted to make a predetermined angle with a horizontal orientation, and after the discharge port finishes discharging the paper, the controller causes the lifter to lower the tray to a predetermined position, and causes the adjuster to adjust the angle of the tray to have a substantially horizontal orientation.

6. The stacker device according to claim 5, wherein the tray includes a first tray and a second tray arranged at an upper side of the first tray, wherein when the controller causes the paper to be discharged onto the first tray, the paper stack depth is a distance from the discharge port to an uppermost paper of the paper stacked on the first tray, and when the controller causes the lifter to lower the first tray and the paper to be discharged onto the second tray, the paper stack depth is a distance from the discharge port to an uppermost paper of the paper stacked on the second tray.

7. A method of stacking paper in stacker device having a tray, adapted to stack the paper discharged from a discharge port thereon, the method comprising:

discharging the paper onto the tray;

detecting a stacked state of the paper and the tray;

extending the tray by rotating an extension tray disposed at one end portion of the tray, and serving as a door cover of the stacker device, wherein the stacker device is in a closed state when an end portion of the extension tray is fixed to a stopper portion;

vertically moving the tray based on the detected stacked state to keep a distance from the discharge port to an uppermost paper of the paper stacked on the tray within a predetermined range, when paper discharged from the discharge port modifies the distance;

tilting the tray such that the tray makes an angle with respect to a horizontal orientation while the tray is positioned such that paper is to be discharged from the discharge port; and lowering the tray to a predetermined position and setting a position of the tray to be substantially horizontal at the predetermined position after discharging the paper onto the tray had ended.

* * * * *